US010428456B2

(12) United States Patent
Liu et al.

(10) Patent No.: US 10,428,456 B2
(45) Date of Patent: Oct. 1, 2019

(54) STEEL WIRE ROPE FOR CONVEYOR BELT

(71) Applicants: JIANGSU FASTEN TECHNOLOGY DEVELOPMENT CENTER CO., LTD, Jiangyin, Jiangsu (CN); JIANGSU FASTEN SPECIAL STEEL PRODUCTS CO., LTD, Jiangyin, Jiangsu (CN)

(72) Inventors: Lihua Liu, Jiangsu (CN); Chunlei Zhang, Jiangsu (CN); Hongfang Liu, Jiangsu (CN); Yongqing Shao, Jiangsu (CN); Yawei Zhang, Jiangsu (CN); Kai Xu, Jiangsu (CN); Yi Lu, Jiangsu (CN)

(73) Assignees: JIANGSU FASTEN TECHNOLOGY DEVELOPMENT CENTER CO., LTD, Jiangyin, Jiangsu (CN); JIANGSU FASTEN SPECIAL STEEL PRODUCTS CO., LTD, Jiangyin, Jiangsu (CN)

( * ) Notice: Subject to any disclaimer, the term of this patent is extended or adjusted under 35 U.S.C. 154(b) by 335 days.

(21) Appl. No.: 15/302,140

(22) PCT Filed: Sep. 10, 2014

(86) PCT No.: PCT/CN2014/086205
§ 371 (c)(1),
(2) Date: Oct. 5, 2016

(87) PCT Pub. No.: WO2015/158103
PCT Pub. Date: Oct. 22, 2015

(65) Prior Publication Data

US 2017/0114497 A1 Apr. 27, 2017

(30) Foreign Application Priority Data

Apr. 14, 2014 (CN) ..... 2014 1 0149551

(51) Int. Cl.
*D07B 1/06* (2006.01)
*D07B 1/10* (2006.01)
(Continued)

(52) U.S. Cl.
CPC ..... *D07B 1/0686* (2013.01); *D07B 1/0613* (2013.01); *D07B 1/10* (2013.01);
(Continued)

(58) Field of Classification Search
CPC ... D07B 1/0613; D07B 1/1686; D07B 1/0686
See application file for complete search history.

(56) References Cited

U.S. PATENT DOCUMENTS 5,475,973 A 12/1995 Furukawa et al.
6,920,745 B2 * 7/2005 Bruyneel ..... D07B 1/0666 57/237
(Continued)

FOREIGN PATENT DOCUMENTS

CN 1740438 A 3/2006
CN 201447621 U 5/2010
(Continued)

OTHER PUBLICATIONS

Machine Translation CN 1740438 (Mar. 2006).*

*Primary Examiner* — Shaun R Hurley
(74) *Attorney, Agent, or Firm* — Novick, Kim & Lee, PLLC; Allen Xue

(57) ABSTRACT

Disclosed is a steel wire rope for conveyor belts. The steel wire rope includes a central steel wire, a steel wire layer externally wound on the central steel wire, and a plurality of external steel wire strands. Each external steel wire strand includes a core steel wire and N external steel wires. The central steel wire, the steel wire layer externally wound on the central steel wire, and the plurality of external steel wire strands are wound into a steel wire rope for conveyor belts
(Continued)

in one step. The steel wire layer is externally wound on the outer side of the central steel wire, the external steel wire strands are wound to wrap the outer side of the steel wire layer, and the external steel wire strands are in line contact with the steel wire layer.

14 Claims, 8 Drawing Sheets

(51) Int. Cl.
*B21C 1/02* (2006.01)
*D07B 3/04* (2006.01)

(52) U.S. Cl.
CPC ..... *B21C 1/02* (2013.01); *D07B 3/04* (2013.01); *D07B 2201/1052* (2013.01); *D07B 2201/1068* (2013.01); *D07B 2201/202* (2013.01); *D07B 2201/2006* (2013.01); *D07B 2201/2051* (2013.01); *D07B 2201/2052* (2013.01); *D07B 2201/2059* (2013.01); *D07B 2201/2061* (2013.01); *D07B 2205/3057* (2013.01); *D07B 2205/3071* (2013.01); *D07B 2207/209* (2013.01); *D07B 2207/4045* (2013.01); *D07B 2401/207* (2013.01); *D07B 2501/2076* (2013.01)

(56) References Cited

U.S. PATENT DOCUMENTS

| | | | | |
|---|---|---|---|---|
| 7,565,791 | B2 * | 7/2009 | Itaya | D07B 1/0673 57/237 |
| 8,601,782 | B2 * | 12/2013 | Nakamura | B60C 9/0007 57/218 |
| 8,833,414 | B2 * | 9/2014 | Masubuchi | B60C 9/0007 152/451 |
| 2003/0226347 | A1 * | 12/2003 | Smith | B66B 7/06 57/210 |
| 2005/0172605 | A1 * | 8/2005 | Vancompernolle | B23K 11/002 57/237 |
| 2011/0088825 | A1 * | 4/2011 | Kudo | B60C 9/0007 152/451 |
| 2015/0075689 | A1 * | 3/2015 | Fukuda | D07B 1/0613 152/451 |

FOREIGN PATENT DOCUMENTS

| | | |
|---|---|---|
| CN | 201553934 U | 8/2010 |
| CN | 102444040 A | 5/2012 |
| CN | 203782476 U | 8/2014 |

* cited by examiner

STEEL WIRE ROPE FOR CONVEYOR BELT

TECHNICAL FIELD

The present invention relates to a steel wire rope, and in particular to a steel wire rope for conveyor belt.

BACKGROUND

With the construction of a lot of mines and docks, high-efficiency, energy-saving and pollution-free belt conveyance substitutes for original short-distance automobile transportation. Key parts and main equipment consumables of such a mode of transportation are conveyor belts. Among others, steel wire rope core conveyor belts adopt steel wire ropes for reinforcement, so that the load-carrying capability of the steel wire rope core conveyor belt is greatly enhanced, and the steel wire rope core conveyor belt can be used as high-speed, large-conveying capability and long-distance conveyor belts. Therefore, the application of the steel wire rope core conveyor belts is widely promoted both domestically and abroad.

Along with the wide application of steel wire rope core conveyor belts, users have increasingly higher requirements on the load-carrying capability of the conveyor belts, and require increasing the load-carrying capability of the conveyor belts by increasing the overall tensile strength of the steel wire rope without changing the size of the steel wire rope and without increasing the costs of production, use, and maintenance. A conventional steel wire rope for conveyor belts includes a core steel wire strand and a plurality of external steel wire strands. The external steel wire strands are helically wound around the outer side of the core steel wire strand. Each of the core steel wire strand and the external steel wire strands includes M core steel wires and N external steel wires. For the conventional steel wire rope for conveyor belts, first, the M core steel wires and the N external steel wires of the core steel wire strand are made into the core steel wire strand; then, the M core steel wires and the N external steel wires of the external steel wire strand are made into the external steel wire strands; finally, a plurality of external steel wire strands are helically wound around the outer side of a core steel wire strand, thus obtaining a finished steel wire rope for conveyor belts. The core steel wire strand and the external steel wire strands in the steel wire rope for conveyor belts are in point contact. The structure of the steel wire rope for conveyor belts is usually 6×7+IWS, 6×19+IWS, 6×19W+IWS, and so on, the construction structures of which are all an m*n steel wire strand combination. IWS stands for Independent Wire Strand. The structure "m*n" means that there are m steel wire strands in total and each steel wire strand consists of n steel wires. The size of the steel wire rope for conveyor belts ranges from ø1 mm to ø10 mm.

SUMMARY

In view of the deficiencies in the prior art, an objective of the present invention is to provide a steel wire rope for conveyor belts, so as to increase the overall tensile strength without changing the size of the steel wire rope and without increasing the costs of production, use, and maintenance, thereby increasing the load-carrying capability of conveyor belts.

To achieve the above objective, the following technical solution is adopted in the present invention: A steel wire rope for conveyor belts, comprising a central steel wire, a steel wire layer externally wound on the central steel wire, and a plurality of external steel wire strands, wherein each external steel wire strand comprises a core steel wire and N external steel wires; the central steel wire, the steel wire layer externally wound on the central steel wire, and the plurality of external steel wire strands are wound into a line contact steel wire rope in one step, the steel wire layer is externally wound on the outer side of the central steel wire, the external steel wire strands are wound to wrap the outer side of the steel wire layer, and the external steel wire strands are in line contact with the steel wire layer; the steel wire layer externally wound on the central steel wire consists of M steel wires or M steel wires and M' externally wound steel wire strands, the number of steel wires of each externally wound steel wire strand is 2 to 12, and when the steel wire layer consists of M steel wires and M' externally wound steel wire strands, M':M=0.25:1 to 1:1. The carbon content of all the steel wires is not less than 0.7%. The number of steel wires of each external steel wire strand is 5 to 12.

In the above-mentioned steel wire rope for conveyor belts, the diameter of the steel wires of the central steel wire is $d_0$, the diameter of the steel wires of the steel wire layer externally wound on the central steel wire is $d_1$, and the diameter of each external steel wire strand is $d_{ExternalStrand}$. The ratio of $d_0$ to $d_1$ is not less than 1.05, and the ratio of $d_{ExternalStrand}$ to $d_1$ is not less than 1.8. The diameters of the core steel wire and the external steel wires in each external steel wire strand are respectively $d_{ExternalStrand1}$ and $d_{ExternalStrand2}$, wherein the ratio of $d_{ExternalStrand1}$ to $d_{ExternalStrand2}$ is not less than 1.03.

In the above-mentioned steel wire rope for conveyor belts, in a further embodiment, the diameter of the central steel wire is do, the diameter of the steel wires in the steel wire layer and the diameter of each externally wound steel wire strand are equal and are $d_1$, the diameter of each external steel wire strand is $d_{ExternalStrand}$, and the diameters of the core steel wire and the external steel wires in each external steel wire strand are respectively $d_{ExternalStrand1}$ and $d_{ExternalStrand2}$, wherein $d_0:d_1$=1.05:1 to 1.2:1, $d_{ExternalStrand}:d_1$=1.8:1 to 5.0:1,and $d_{ExternalStrand1}:d_{ExternalStrand2}$=1.03:1 to 1.5:1.

In the present invention, without changing the diameter of the steel wire rope and the diameter and number of the external steel wire strands, the central steel wire, the steel wire layer externally wound on the central steel wire, and the plurality of external steel wire strands are wound into a steel wire rope for conveyor belts in one step, in which the external steel wire strands and the steel wire layer are in line contact. Therefore, for the entire steel wire rope, except for the external steel wire strands, the filling area of the core steel wires can be increased by 8% to 10%, and the overall tensile strength can be increased by 10% to 15% when the strength level of the steel wires used stays the same.

Because the central steel wire, the steel wire layer externally wound on the central steel wire, and the plurality of external steel wire strands are wound into the steel wire rope for conveyor belts in one step, reducing one winding step so as to reducing the strength loss of the steel wires, so that the overall tensile strength is increased. In terms of the reduction in the strength loss caused by winding, the overall tensile strength can be increased by 1% to 3%. In addition, the elongation in the entire rope is decreased. Compared with a conventional steel wire rope formed by three steps, the elongation of the steel wire rope of the present invention can be decreased by 0.2% to 0.5%.

Compared with the present technology, the present invention has the following advantages: The present invention can increase the tensile strength of the steel wire rope for conveyor belts without changing the size and the strength level of the steel wire rope. The present invention can decrease the elongation in the steel wire rope when the size of the steel wire rope is kept constant. The present invention can reduce the strength loss of some steel wires, mainly the core steel wires, of the steel wire rope in the winding process.

DETAILED DESCRIPTION

The present invention is further described in detail below with reference to the accompanying drawings and specific embodiments.

Figure 1:
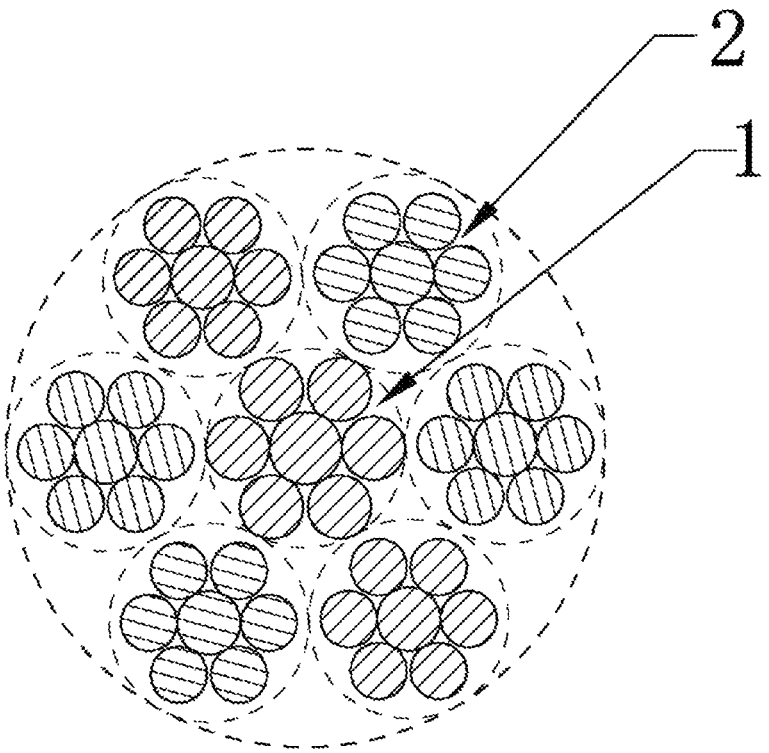
FIG. 1 Prior Art
FIG. 1 is a schematic structural view of a 6*7+1*7 structure of a conventional steel wire rope for conveyor belts.
Figure 4:
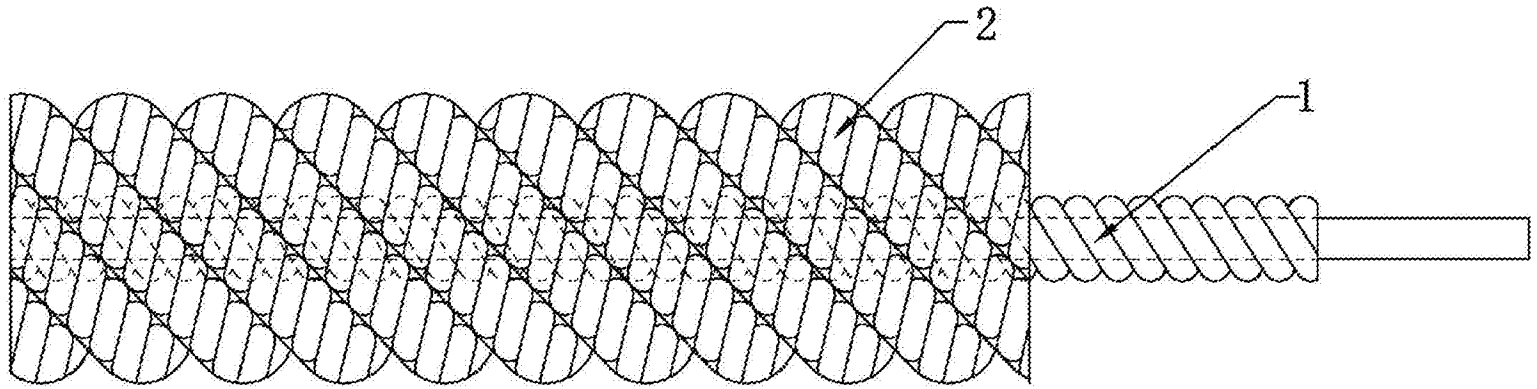
FIG. 4 Prior Art
FIG. 4 is a schematic view of the cross section, showing internal points of contact of a conventional steel wire rope for conveyor belts.
Figure 5:
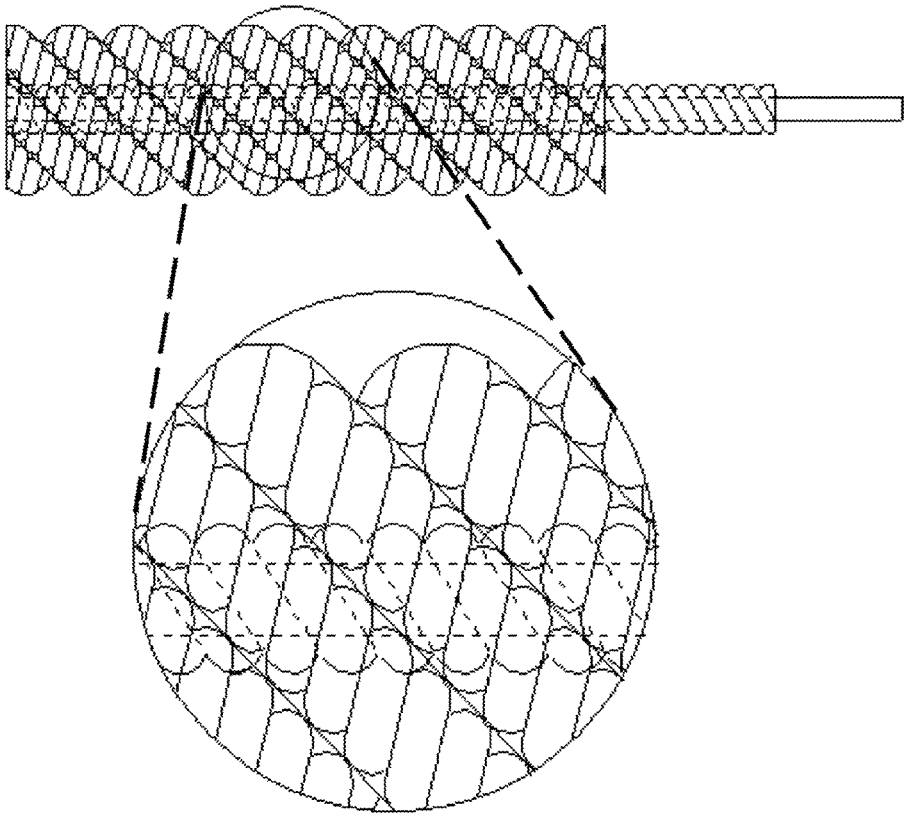
FIG. 5 Prior Art
FIG. 5 is a partially enlarged view of the cross section, showing internal points of contacts of a conventional steel wire rope for conveyor belts.

As shown in FIG. 1, FIG. 4, and FIG. 5, a conventional steel wire rope for conveyor belts includes a core steel wire strand 1 and a plurality of external steel wire strands 2. The external steel wire strands 2 are helically wound on the outer side of the core steel wire strand 1. The steel wire rope is of a 6*7+1*7 structure. The core steel wire strand 1 is in point contact with the external steel wire strands 2.

Embodiment 1

The structure of an inventive steel wire rope for conveyor belts according to the present invention is 1+m+m*n, wherein m is a collection of 5 to 8 steel wires or a combination of 5 to 8 steel wires and a number of externally wound steel wire strands. When the combination of M steel wires and M' externally wound steel wire strands is adopted, M:M'=4:1 to 1:1; and n is the number of external steel wire strands consisting of 5 to 12 steel wires. The size of the inventive steel wire rope for conveyor belts ranges from ø1 mm to ø10 mm.

Figure 2:
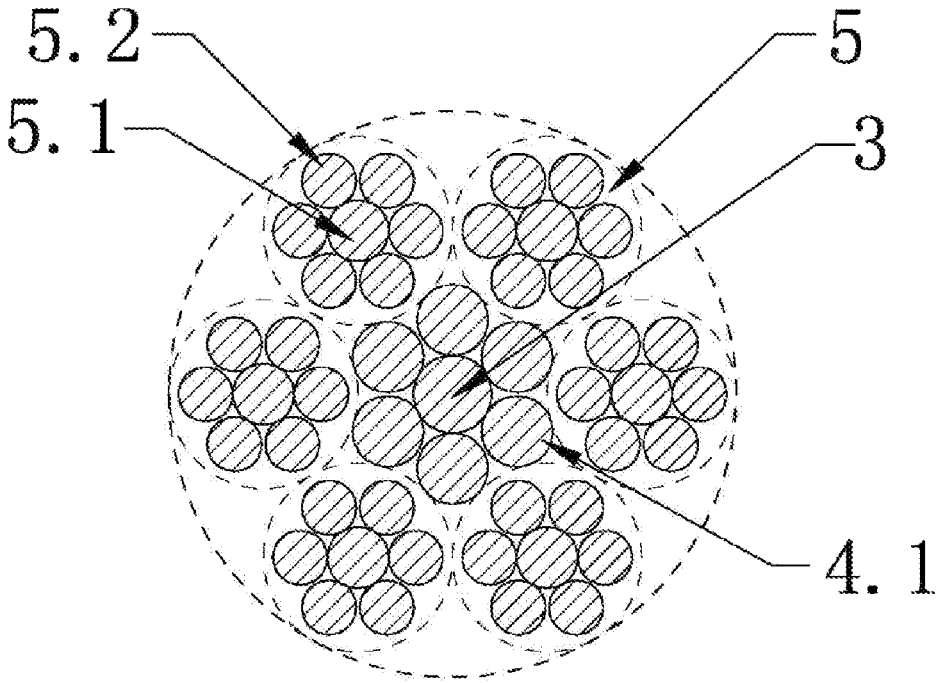
FIG. 2 is a schematic structural view of a 6*7+6+1 structure with a steel wire layer consisting of only steel wires according to the present invention.
Figure 6:
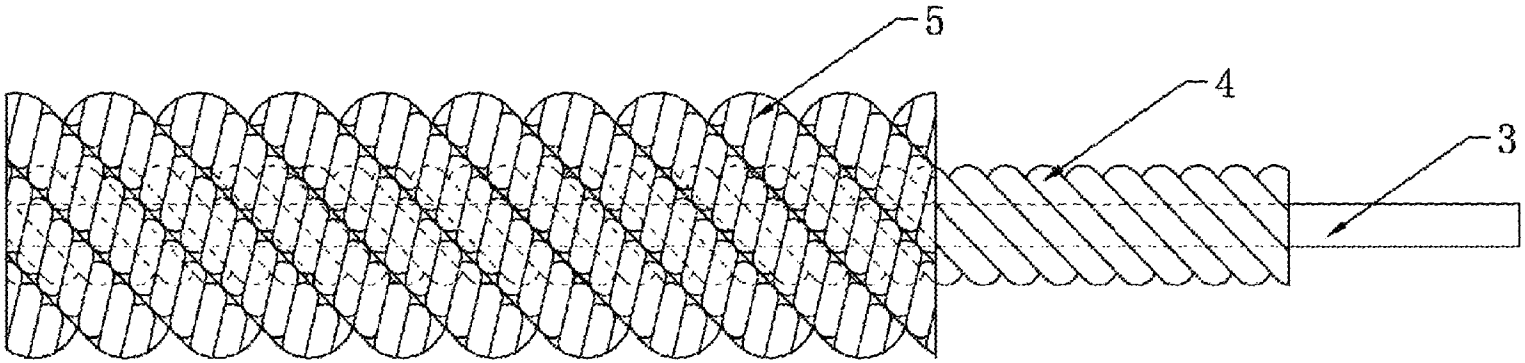
FIG. 6 is a schematic view of the cross section, showing the lines of contact in a steel wire rope according to the present invention.
Figure 7:
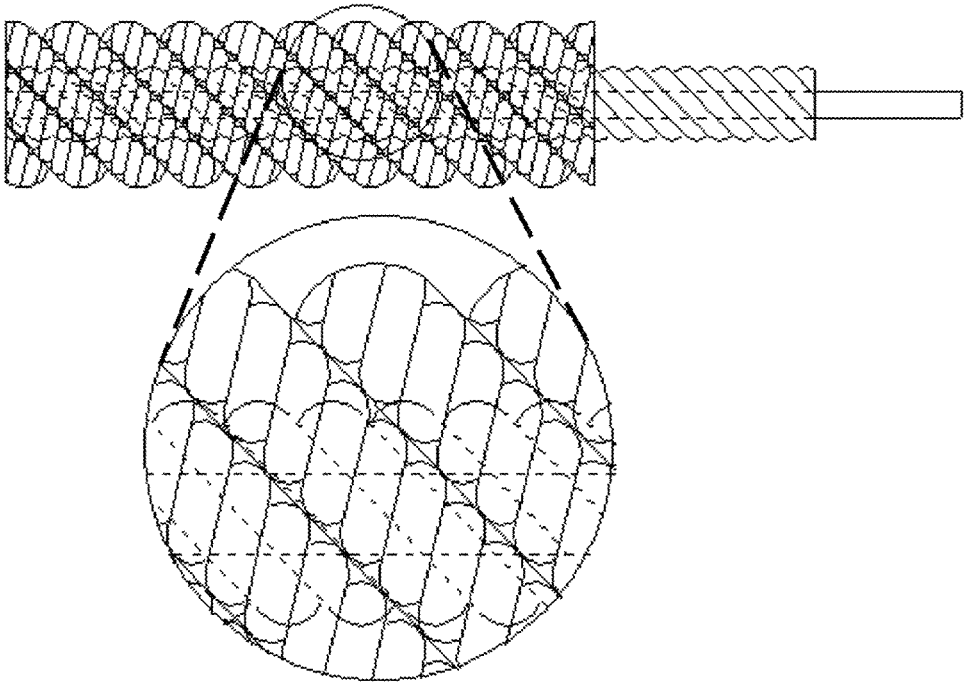
FIG. 7 is a partially enlarged view of the cross section, showing the lines of contact in a steel wire rope according to the present invention.

As shown in FIG. 2, FIG. 6, and FIG. 7, the steel wire rope for conveyor belts in this embodiment includes a central steel wire 3, a steel wire layer 4 externally wound on the central steel wire, and six external steel wire strands 5. Each external steel wire strand 5 includes a core steel wire 5.1 and six external steel wires 5.2. The central steel wire 3, the steel wire layer 4 externally wound on the central steel wire, and the six external steel wire strands 5 are wound into a steel wire rope for conveyor belts in one step. The steel wire layer 4 is externally wound on the outer side of the central steel wire 3, the external steel wire strands 5 are wounded to wrap the outer side of the steel wire layer 4, and the external steel wire strands 5 are in line contact with the steel wire layer 4. The steel wire layer 4 externally wound on the central steel wire 3 consists of six steel wires 4.1. The diameter do of the central steel wire 3 is 0.56 mm, the diameter $d_1$ of the steel wires 4.1 in the steel wire layer 4 is 0.51 mm, the diameter $d_{ExternalStrand}$ of each external steel wire strand 5 is 1.22 mm, and the diameters of the core steel wire 5.1 and the external steel wires 5.2 in each external steel wire strand 5 are respectively $d_{ExternalStrand1}$=0.44 mm and $d_{ExternalStrand2}$=0.39 mm.

Embodiment 2

Figure 3:
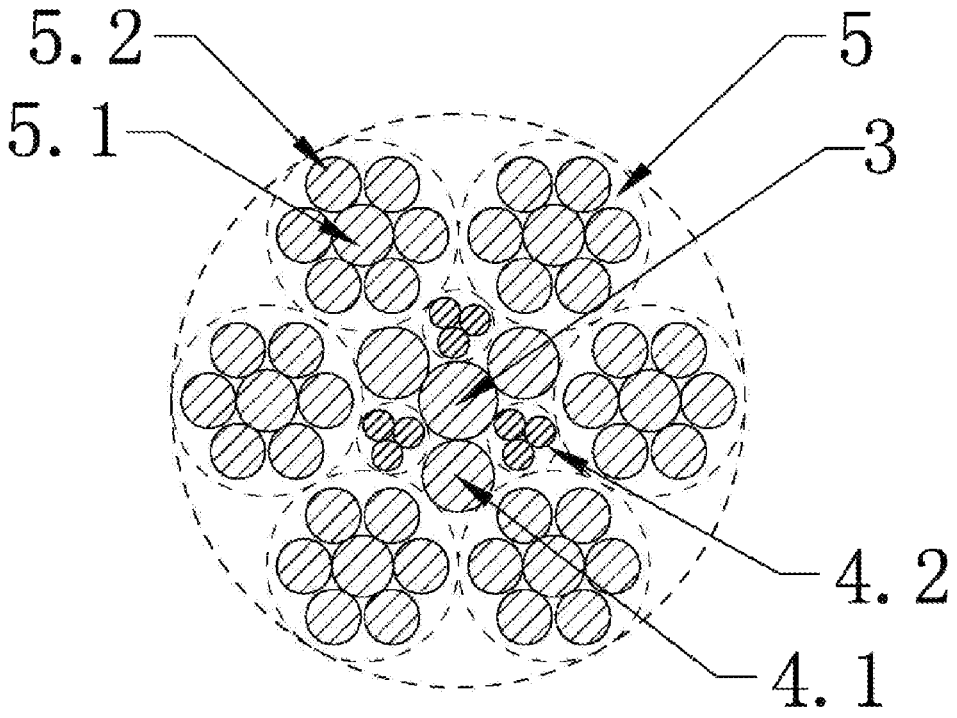
FIG. 3 is a schematic structural view of a 6*7+6+1 structure with a steel wire layer consisting of three steel wires and three externally wound steel wire strands according to the present invention.

As shown in FIG. 3, FIG. 6, and FIG. 7, a steel wire rope for conveyor belts in this embodiment includes a central steel wire 3, a steel wire layer 4 externally wound on the central steel wire, and six external steel wire strands 5. Each external steel wire strand 5 includes a core steel wire 5.1 and six external steel wires 5.2. The central steel wire 3, the steel wire layer 4 externally wound on the central steel wire, and the six external steel wire strands 5 are wound into a steel wire rope for conveyor belts in one step. The steel wire layer 4 is externally wound on the outer side of the central steel wire 3, the external steel wire strands 5 are wounded to wrap the outer side of the steel wire layer 4, and the external steel wire strands 5 are in line contact with the steel wire layer 4. The steel wire layer 4 externally wound on the central steel wire 3 consists of three steel wires 4.1 and three externally wound steel wire strands 4.2. The number of steel wires of each externally wound steel wire strand 4.2 is 3. The diameter do of the central steel wire 3 is 0.56 mm, the diameter of the steel wires 4.1 in the steel wire layer 4 and the diameter of each steel wire strand 4.2 are equal and are $d_1$=0.51 mm, the diameter $d_{ExternalStrand}$ of each external steel wire strand is 1.22 mm, and the diameters of the core steel wire and the external steel wires in each external steel wire strand are respectively $d_{ExternalStrand1}$=0.44 mm and $d_{Externalstrand2}$=0.39 mm.

The steel wires and strands are formed into a line contact structure in one step by means of process designing and production equipment without changing the diameter of the steel wire rope and the diameter and number of the external steel wire strands.

For the entire steel wire rope, besides the external steel wire strands, the filling area of the core steel wires can be increased by 8% to 10%, and the overall tensile strength can be increased by 10% to 15% when the strength level of the steel wires is kept constant.

Because the core steel wires and the external steel wire strands are formed in one step, one winding step for making the core steel wires is omitted, and the strength loss of the steel wires is reduced, so that the overall tensile strength is increased. Because of the reduction in the strength loss caused by winding, the overall tensile strength can be increased by 1% to 3%.

Because the core steel wires are deformed only once, the elongation of the entire rope is decreased. Compared with a conventional steel wire ropes formed by three steps, the elongation in the steel wire rope of the present invention can be decreased by 0.2% to 0.5%.

Embodiment 3

Taking ø3.5 mm steel wire ropes as an example, the tensile strength of steel wire ropes having different structures that are produced according to the structure of a conventional steel wire rope for conveyor belts and the structure of an inventive steel wire rope for conveyor belts are compared.

Material selection: steel rods having 0.70% to 1.00% of carbon, 0.30% to 0.90% of manganese, 0.15% to 0.50% of silicon, 0.03% of sulfur at most, and 0.03% of phosphorus at most, the percentages being percentages by weight.

Pickling and phosphatization of steel wires: Pickle, rinse, dry and weakly phosphatize the steel rods together to remove impurities and oxides from the surface of the steel rods.

Large diameter drawing: Draw the steel rods for the first time using a straight line drawing machine to a diameter of about 2.0 mm to 3.0 mm.

Intermediate heat treatment: Eliminate work hardening resulting from the first drawing in preparation for the second drawing.

Hot galvanization: Perform hot-dip galvanization on the semifinished steel wires obtained after the heat treatment so that the semifinished steel wires have an even and bright zinc layer with a particular thickness.

Wet drawing: Finally draw the semifinished steel wires into steel wires for rope production, the final diameter of the steel wires being 0.10 mm to 0.80 mm.

Semifinished product winding: Wind the steel wires for rope production into steel wire strands using a tubular strander, for use as external steel wire strands of the steel wire rope.

Figure 8:
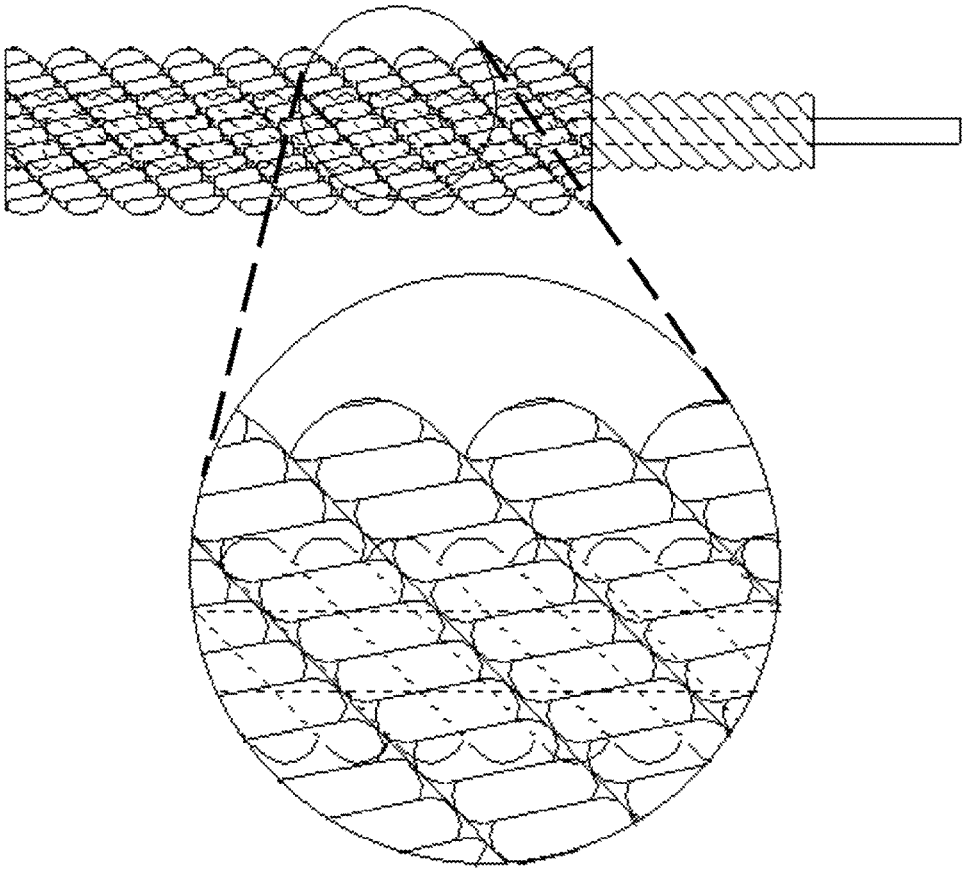
FIG. 8 is a schematic view (reverse winding) of the cross section, showing the lines contact in a steel wire rope according to the present invention.

Finished product winding: Form a central steel wire, a steel wire layer externally wound on the central steel wire, and a plurality of external steel wire strands into a line contact steel wire rope in one step by using a tubular strander whose pay-off reel is twice the size of that in the tubular strander for semifinished product winding, wherein the winding direction of the external steel wire strands is the same as or opposite to that of the finished product (in the steel wire rope illustrated in FIG. 8, the winding direction of the external steel wire strands is opposite to that of the finished product), the lay pitch of the finally formed finished product is equal to that of the steel wire layer externally wound on the central steel wire, and the lay pitch of the external steel wire strands remains unchanged.

According to the present invention, the change in the product properties of steel wire ropes having different structures along with the change in the wire diameters is shown in the following table.

| Item | Structure 1 of the present invention | Structure 2 of the present invention | Conventional structure |
|---|---|---|---|
| Steel wire rope diameter (mm) | 3.65-3.70 | 3.65-3.70 | 3.65-3.70 |
| Tensile strength (kN) | 17.16-18.25 | 16.89-17.58 | 14.41-15.60 |
| External strand diameter (mm) | 1.22 | 1.22 | 1.22 |
| Core area ($mm^2$) | 1.471 | 1.303 | 1.108 |
| Stretch (%) | 1.98-2.07 | 1.99-2.10 | 2.10-2.25 |

The above descriptions are merely preferred embodiments of the present invention, and are not intended to limit the scope of implementation of the present invention. Various variations and modifications made by those skilled in the art by adopting the principle and technical features of the present invention shall all fall within the protection scope as defined by the appended claims.

What is claimed is:

1. A steel wire rope for conveyor belt, comprising:

a central steel wire, a steel wire layer externally wound about the central steel wire, and a plurality of external steel wire strands, wherein each external steel wire strand comprises a core steel wire and N external steel wires; the central steel wire, the steel wire layer externally wound about the central steel wire, and the plurality of external steel wire strands are wound to form a line contact steel wire rope in one step, the plurality of external steel wire strands are wound about an outer surface of the steel wire layer and are in line contact with the steel wire layer, and wherein the steel wire layer externally wound on the central steel wire comprises M steel wires.

2. The steel wire rope for conveyor belt according to claim 1, wherein the steel wire layer externally wound on the central steel wire consists of M steel wires and M' externally wound steel wire strands, M':M=0.25:1 to 1:1, and M is 2 to 12.

3. The steel wire rope for conveyor belt according to claim 1, wherein N is an integer of 5 to 12.

4. The steel wire rope for conveyor belt according to claim 1, wherein a carbon content of all the steel wires is not less than 0.7%.

5. The steel wire rope for conveyor belt according to claim 4, wherein the carbon content of all the steel wires is 0.70% to 1.00%.

6. The steel wire rope for conveyor belt according to claim 1, wherein a diameter of the central steel wire is $d_0$, a diameter of each of the steel wires in the steel wire layer externally wound about the central steel wire is $d_1$, and a diameter of each of the plurality of external steel wire strands is $d_{ExternalStrand}$, wherein a ratio of $d_0$ to $d_1$ is not less than 1.05, and a ratio of $d_{ExternalStrand}$ to $d_1$ is not less than 1.8.

7. The steel wire rope for conveyor belt according to claim 6, wherein a diameter of the central steel wire is $d_0$, $d_0$:$d_1$=1.05:1 to 1.2:1, and $d_{ExternalStrand}$:$d_1$=1.8:1 to 5.0:1.

8. The steel wire rope for conveyor belt according to claim 2, wherein a diameter of the central steel wire is $d_0$, a diameter of each of the steel wires in the steel wire layer externally wound about the central steel wire and a diameter of each of the externally wound steel wire strands are equal and are $d_1$, and a diameter of each of the plurality of external steel wire strands is $d_{ExternalStrand}$, wherein $d_0$:$d_1$=1.05:1 to 1.2:1, and $d_{ExternalStrand}$:$d_1$=1.8:1 to 5.0:1.

9. The steel wire rope for conveyor belt according to claim 1, wherein a diameter of the core steel wire and a diameter of each of the external steel wires in each external steel wire strand are respectively $d_{ExternalStrand1}$ and $d_{ExternalStrand2}$, wherein a ratio of $d_{Externalstrand1}$ to $d_{ExternalStrand2}$ is not less than 1.03.

10. The steel wire rope for conveyor belt according to claim 9, wherein $d_{ExternalStrand1}$:$d_{ExternalStrand2}$=1.03:1 to 1.5:1.

11. A method for producing a steel wire rope for conveyor belt, comprising:

selecting steel wires comprising 0.70% to 1.00% of carbon, 0.30% to 0.90% of manganese, 0.15% to 0.50% of silicon, less than 0.03% of sulfur, and less than 0.03% of phosphorus, wherein the percentages being percentages by weight;

pickling, rinsing, drying and phosphatizing the steel wires together to remove impurities and oxides from a surface of the steel wires;

drawing the steel wires using a straight line drawing machine;

heat treating the drawn steel wires;

performing hot-dip galvanization to coat a zinc layer on the heat-treated steel wires to obtain semifinished steel wires;

drawing the semifinished steel wires into finished steel wires;

winding the finished steel wires using a first tubular strander to obtain a plurality of external steel wire strands; and winding a central steel wire, a steel wire layer externally wound on the central steel wire, and the plurality of external steel wire strands into a line contact steel wire rope in one step using a second tubular strander, wherein a pay-off reel in the second tubular strander is twice the size of a pay-off reel in the first tubular strander, wherein a lay pitch of the steel wire rope is equal to that of the steel wire layer externally wound on the central steel wire.

12. The method of claim 11, wherein a lay pitch of the external steel wire strands remains unchanged.

13. The method of claim 11, a direction of winding the external steel wire strands is the same as a direction of winding of the steel wire layer externally wound on the central steel wire.

14. The method of claim 11, a direction of winding the external steel wire strands is opposite to a direction of winding of the steel wire layer externally wound on the central steel wire.

* * * * *